US008365472B2

(12) United States Patent
Grimaldi

(10) Patent No.: US 8,365,472 B2
(45) Date of Patent: Feb. 5, 2013

(54) FOLDAWAY RAILED BALCONY, PARTICULARLY FOR BOATS

(75) Inventor: Michele Grimaldi, Piossasco (IT)

(73) Assignee: Opacmare S.p.A., Rivalta (Torino) (IT)

( * ) Notice: Subject to any disclaimer, the term of this patent is extended or adjusted under 35 U.S.C. 154(b) by 106 days.

(21) Appl. No.: 12/966,424

(22) Filed: Dec. 13, 2010

(65) Prior Publication Data

US 2011/0138700 A1 Jun. 16, 2011

(30) Foreign Application Priority Data

Dec. 14, 2009 (IT) ..... TO2009A0983

(51) Int. Cl.
*E04B 1/346* (2006.01)

(52) U.S. Cl. ..... 52/69; 52/73; 52/79.6; 114/362; 114/364

(58) Field of Classification Search ..... 52/69, 73, 52/79.6; 114/362, 364
See application file for complete search history.

(56) References Cited

U.S. PATENT DOCUMENTS

| | | | | | |
|---|---|---|---|---|---|
| 1,134,635 | A | * | 4/1915 | Osborn | 52/69 |
| 1,733,172 | A | * | 10/1929 | Stover | 182/131 |
| 3,399,922 | A | * | 9/1968 | Burton | 296/164 |
| 4,015,827 | A | * | 4/1977 | Brand | 256/59 |
| 4,413,855 | A | * | 11/1983 | Flanagan | 296/162 |
| 4,495,883 | A | * | 1/1985 | Hoy | 114/343 |
| 4,535,933 | A | * | 8/1985 | Kuiper | 237/12.3 A |
| 4,869,030 | A | * | 9/1989 | Clark | 52/79.6 |
| 4,889,057 | A | * | 12/1989 | Chartrand | 108/42 |
| D318,390 | S | * | 7/1991 | Murray | D6/513 |
| 5,193,878 | A | * | 3/1993 | Weaver | 296/162 |
| 5,667,267 | A | * | 9/1997 | Talucci | 296/26.15 |
| 6,345,471 | B1 | * | 2/2002 | Gyllenhammar | 52/69 |
| 7,409,921 | B1 | * | 8/2008 | Jones | 114/362 |
| 7,686,381 | B1 | * | 3/2010 | Leonard | 296/162 |
| 8,028,641 | B1 | * | 10/2011 | Sly | 114/363 |

(Continued)

FOREIGN PATENT DOCUMENTS

| | | | |
|---|---|---|---|
| DE | 200 04 539 | U1 | 8/2000 |
| DE | 103 34 256 | A1 | 2/2005 |
| WO | 2004/109024 | A1 | 12/2004 |

OTHER PUBLICATIONS

Search Report for corresponding Italian Patent Application No. TO20090983 dated Aug. 19, 2010.

(Continued)

*Primary Examiner* — Brian Glessner
*Assistant Examiner* — Joshua Ihezie
(74) *Attorney, Agent, or Firm* — Sughrue Mion, PLLC

(57) ABSTRACT

A foldaway balcony comprises a platform structure tiltably mounted on a wall and a rail structure mounted to the platform structure. The platform structure comprises a box-like support structure and a planar floor structure which are tiltable relative to the wall separately from each other. The rail structure comprises a plurality of rail elements, which are hinged at the edge of the support structure of the platform structure, and are tiltable between a stored position, in which they lay within the support structure, and a deployed position, in which they stand relative to the support structure. When the platform structure moves from the closed position to the open position, first the support structure is tilted, then the rail elements move from the stored position to the deployed position, and finally the floor structure is tilted.

5 Claims, 6 Drawing Sheets

U.S. PATENT DOCUMENTS

| | | | | |
|---|---|---|---|---|
| 2002/0189503 | A1* | 12/2002 | Hansen | 108/44 |
| 2003/0178253 | A1* | 9/2003 | Tatge et al. | 182/132 |
| 2004/0026958 | A1* | 2/2004 | Condino | 296/156 |
| 2005/0019128 | A1* | 1/2005 | Sain | 410/46 |
| 2006/0145514 | A1* | 7/2006 | Cardwell et al. | 296/162 |
| 2008/0296922 | A1* | 12/2008 | Diamond et al. | 296/26.13 |
| 2009/0050865 | A1* | 2/2009 | Napier | 256/37 |
| 2010/0101459 | A1* | 4/2010 | Nelson | 108/47 |
| 2012/0079978 | A1* | 4/2012 | Teel | 114/343 |

OTHER PUBLICATIONS

Written Opinion for corresponding Italian Patent Application No. TO20090983 dated Dec. 14, 2009.

European Search Report for EP Application No. EP10194654, Apr. 11, 2011.

* cited by examiner

FOLDAWAY RAILED BALCONY, PARTICULARLY FOR BOATS

The present invention relates to a foldaway balcony, comprising a platform structure tiltably mounted on a wall, said platform structure being able to adopt a closed position in which it is disposed substantially aligned with the wall, and an open position in which it is disposed cantilevered from the wall, and further comprising a railing structure mounted on the platform structure.

Foldaway balconies are particularly mounted on luxury boats.

The present invention is characterized in that said platform structure includes a box-like support structure and a planar floor structure which are tiltable separately from one another relative to the wall; and said railing structure includes a plurality of railing elements, said railing elements being hinged at the edge of said support structure of the platform structure, and being tiltable between a stored position in which they lie inside the support structure, and a deployed position in which they stand up relative to the support structure;

wherein when the platform structure switches from the closed position to the open position, the support structure is tilted at first, then the railing elements switch from the stored position to the deployed position, and at last the floor structure is tilted.

Preferred embodiments of the invention are defined in the dependent claims, which are to be considered as being an integral part of the present disclosure.

Further characteristics and advantages of the device according to the invention will be better understood by means of the following detailed description of an embodiment of the invention, which is given with reference to the annexed drawings, which are provided by way of non-limiting illustration, in which.

With reference to the figures, a foldaway balcony has been illustrated according to the invention, which is generally designated with 10. This type of balcony is commonly mounted on luxury boats. The figures relate to this particular type of application, and illustrate the balcony 10 as being mounted on a wall M of a boat, uprights C standing from the top thereof to support a handrail B extending along the top of the wall M. An inner floor P of the boat can be also seen in the Figures, which floor is substantially flush with the balcony floor when the balcony is in the open position. It should be understood that the invention is not limited to this exemplary installation, as it can be more generally applied to a substantially vertical wall of a fixed or movable structure.

Figure 1:
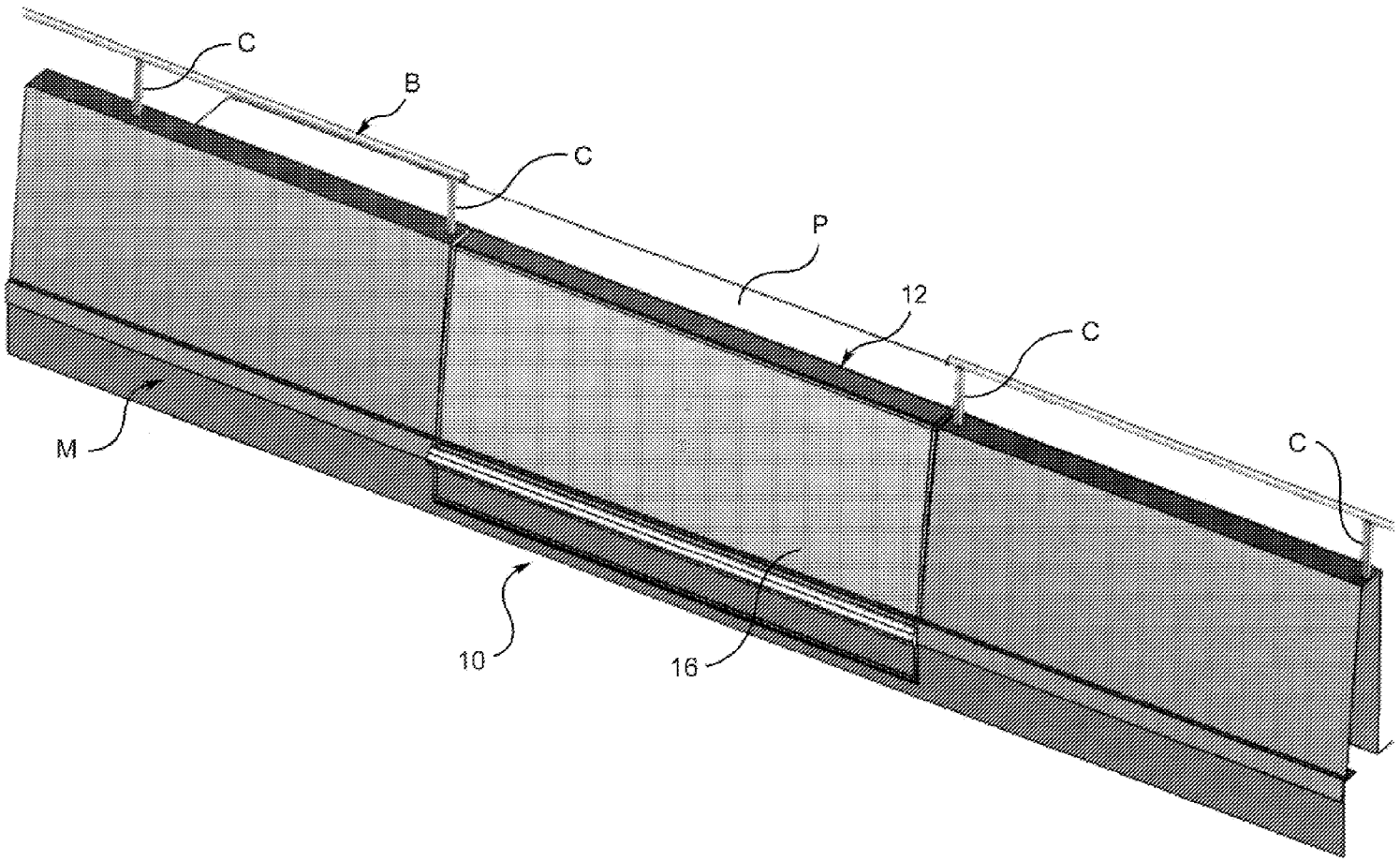
FIG. 1 is a front perspective view of a foldaway balcony according to the invention, in the closed position.
Figure 2:
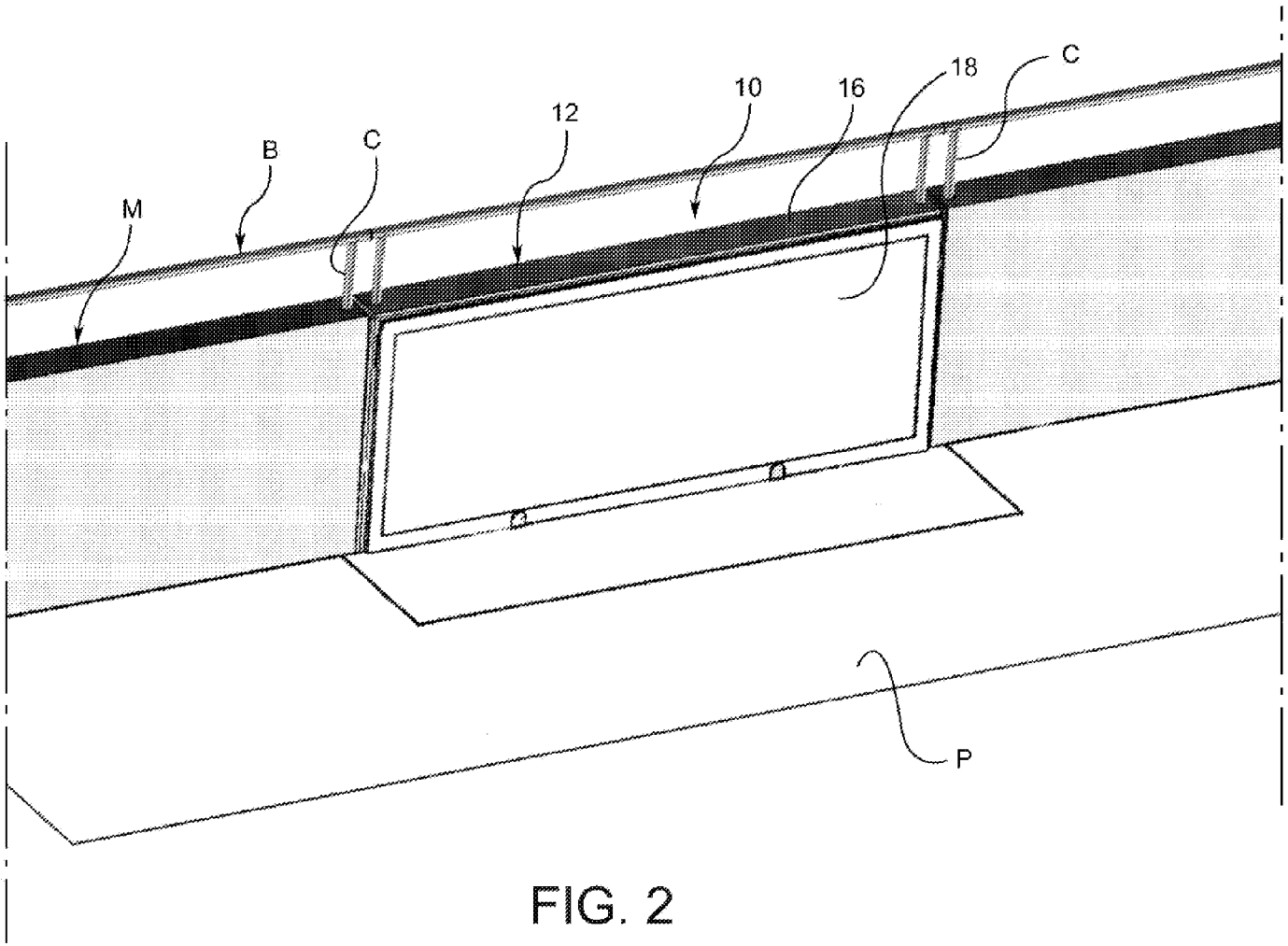
FIG. 2 is a rear perspective view of the balcony of FIG. 1.
Figure 3:
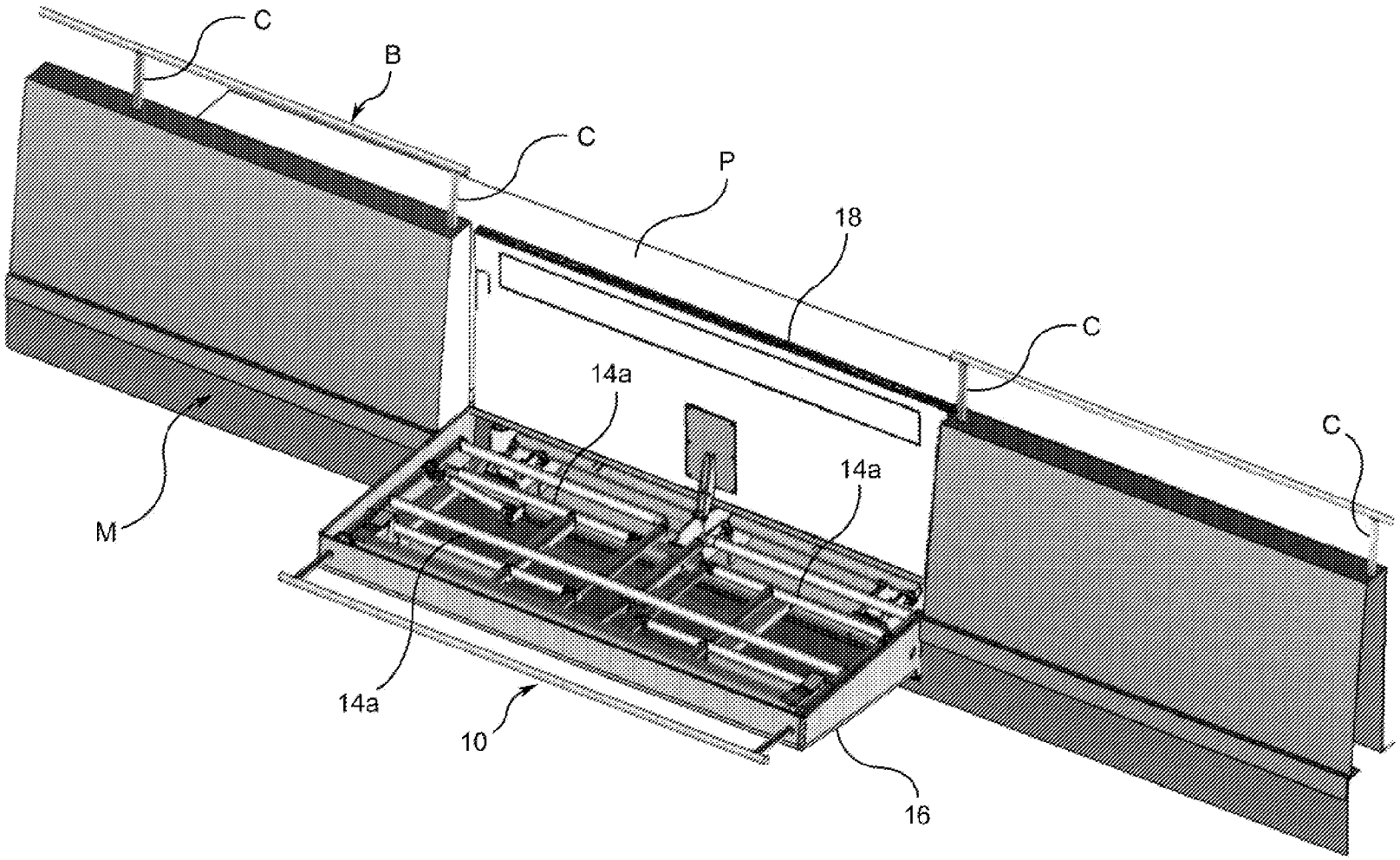
FIG. 3 is a front perspective view of the balcony, with the support structure thereof being tilted.
Figure 4:
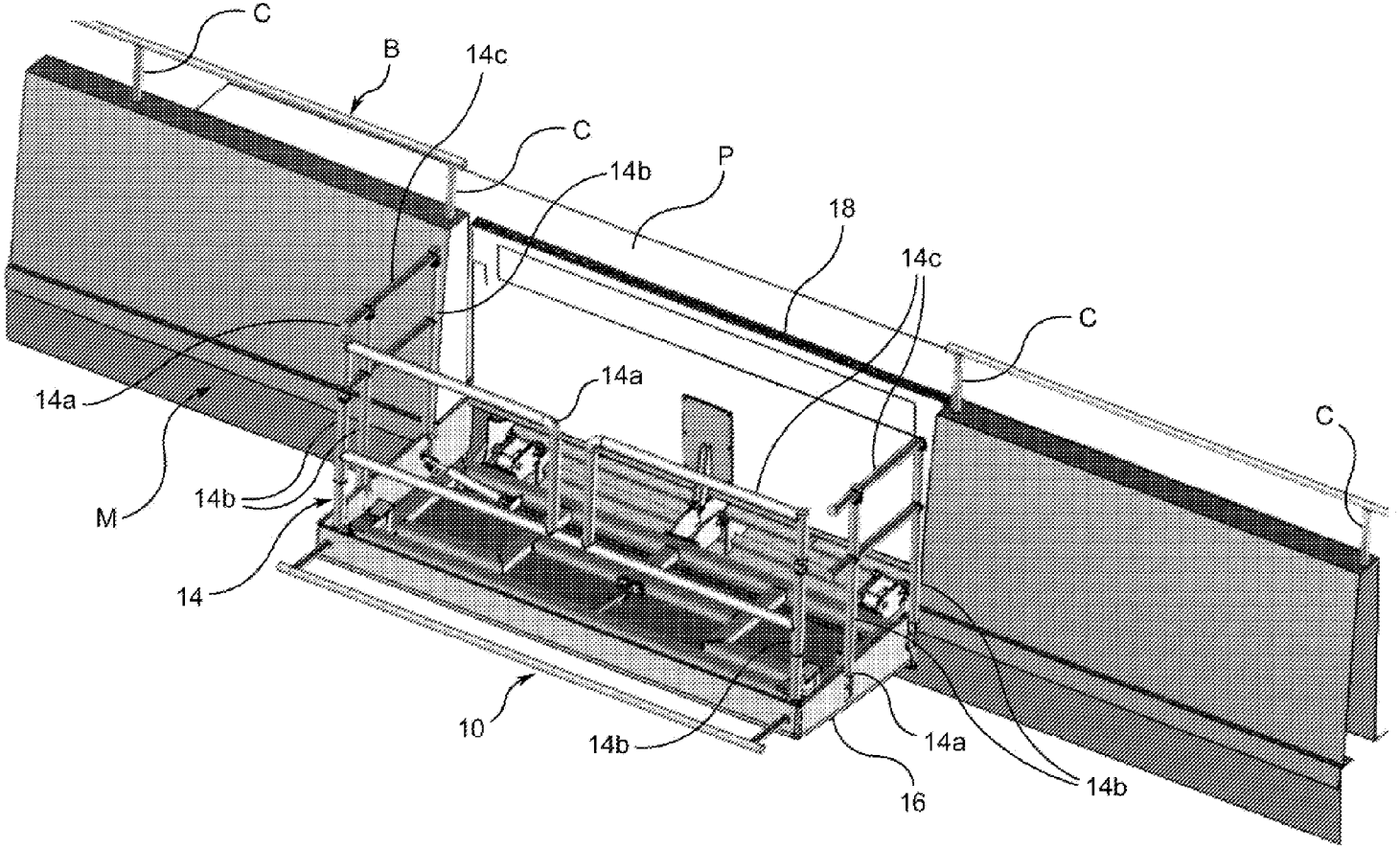
FIG. 4 is a front perspective view of the balcony, with the rail elements thereof being in the deployed position.
Figure 5:
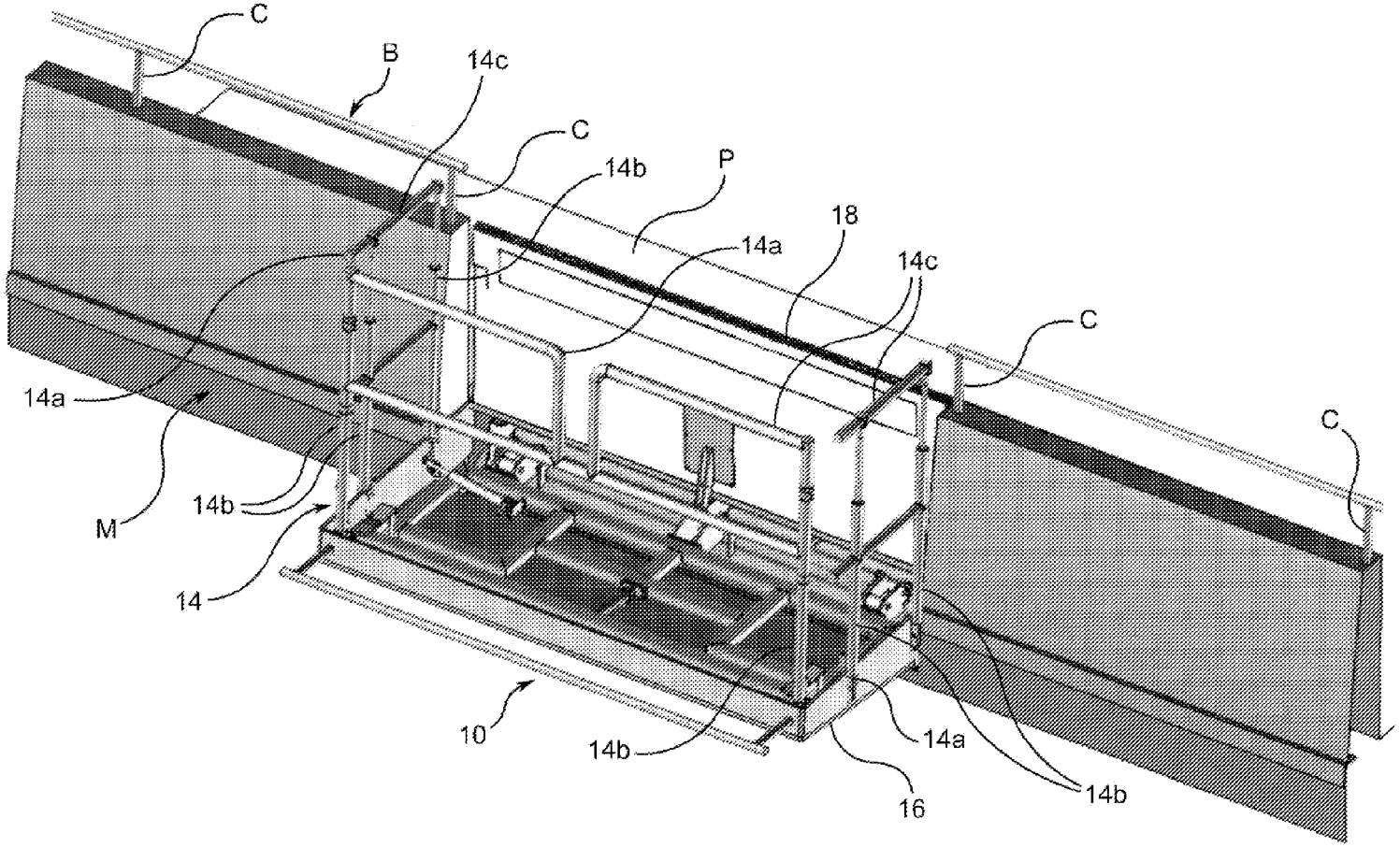
FIG. 5 is a front perspective view of the balcony, with the rail elements thereof being telescopically extended.
Figure 6:
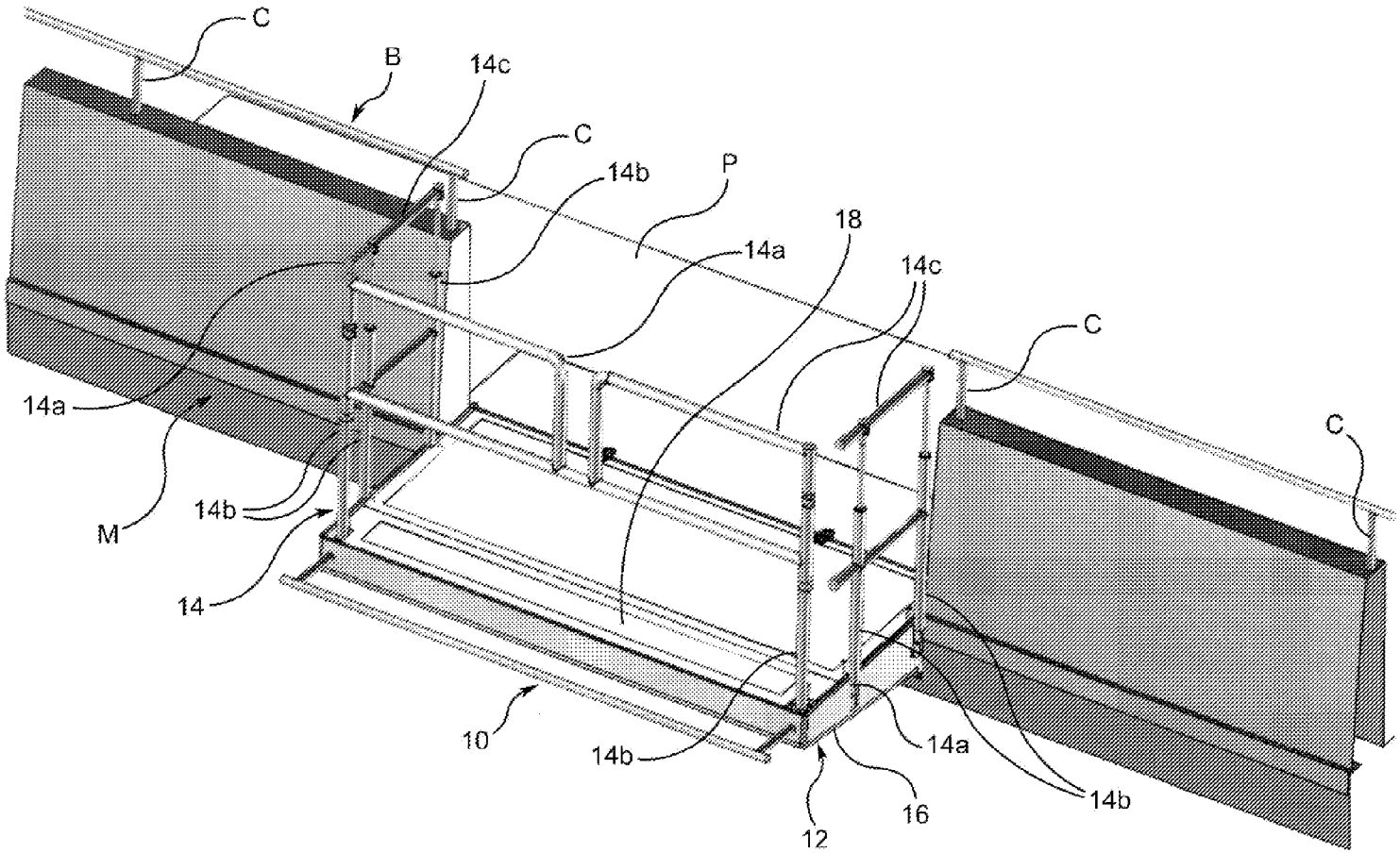
FIG. 6 is a front perspective view of the balcony, in the open position.

The balcony 10 comprises a platform structure 12 that is tiltably mounted to the wall M. The platform structure 12 is capable of adopting a closed position (see FIGS. 1 and 2), in which it is arranged substantially aligned to the wall M, and an open position, in which it is arranged cantilevered from the wall M (see FIG. 6). In the closed position, the platform structure 12 is a part of the wall, without interruption from the surrounding wall. In the open position, when the platform structure 12 is lowered, a hole is created in the wall M which allows the access to the balcony from the inside of the boat, and vice versa.

The balcony 10 further comprises a rail structure 14 mounted to the platform structure 12, which can be seen in FIGS. 3 to 6.

The platform structure 12 comprises a box-like support structure 16 and a planar floor structure 18. The support structure 16 and the floor structure 18 are tiltable relative to the wall M independently from each other. The tilt axes of these structures are substantially parallel to the wall M. The tilt movement is obtained in a conventional manner; for example, the support structure and the floor structure can be connected to the wall by means of respective joints, and be driven by respective actuators, such as hydraulic cylinders.

The rail structure 14 comprises a plurality of rail elements 14*a*, which are hinged at the edge of the support structure 16 of the platform structure 12. In the example illustrated herein, three different rail elements 14*a* are provided, which are associated with the three exposed sides of the balcony, respectively. Each rail element 14*a* is made of a frame made of tubular elements, and essentially comprises two uprights or stanchions 14*b*, which are hinged to the edge of the support structure 16, and a handrail 14*c* extending between these uprights 14*b*. Each rail element 14*a* is tiltable between a stored position (see FIG. 3), in which it lies within the support structure 16, and a deployed position, in which it stands relative to the support structure 16 (see FIGS. 4 to 6). The tilt axis of each rail element 14*a* is substantially parallel to the side of the balcony with which it is associated.

Preferably, the uprights 14*b* of the rail elements 14*a* have a telescopic structure, the elongation/retraction thereof being driven by a respective actuator, such as a hydraulic cylinder. After the rail elements 14*a* are in the deployed position, they can be so elongated that the respective handrails 14*c* are brought flush with the handrail B of the adjacent wall M (see FIGS. 5 and 6).

The opening movement of the above-mentioned balcony 10 is as follows.

During the shift of the platform structure 12 from the closed position to the open position, the support structure 16 is first tilted, in which the rail elements 14*a* are contained (see FIGS. 1 to 3), which will be stopped after the final open position thereof has been reached. The floor structure 18 remains initially aligned to the inner side of the wall M. When the movement of the support structure 16 has come to an end, or when there is a sufficient space available to avoid interference with the platform structure 18, the rail elements 14*a* are operated such as to shift from the stored position to the deployed position (see FIG. 4), and optionally extended to the preset height (see FIG. 5). After the deployment of the rail elements 14*a* has been completed, the floor structure 18 is then tilted, which will stop by finally closing on the support structure 16.

It should be understood that the invention is not limited to the embodiment described and illustrated herein, but modifications can be made to the same in terms of parts, construction and operation details, according to the number of possible variant embodiments which will be deemed suitable by those skilled in the art, and which are to be regarded as comprised within the scope of the invention, such as defined in the following claims.

The invention claimed is:

1. A foldaway balcony, comprising a platform structure tiltably mounted on a wall, said platform structure being able to assume a closed position in which it is disposed substantially aligned with the wall, and an open position in which it is disposed cantilevered from the wall, and further comprising a railing structure mounted on the platform structure, wherein said platform structure includes a substantially box-shaped support structure and a planar floor structure which are tiltable separately from one another relative to the wall; and said railing structure includes a plurality of railing elements, said railing elements being hinged at an edge of said support structure of the platform structure, and being tiltable between a stored position in which they lie inside the support structure, and a deployed position in which they stand up relative to the support structure;

wherein in said closed position the railing elements are interposed between the support structure and the floor structure, and wherein when the platform structure switches from the closed position to the open position, the support structure is tilted at first, then the railing elements switch from the stored position to the deployed position, and at last the floor structure is tilted.

2. A balcony according to claim 1, in which a tilt axes of the support structure and of the floor structure are substantially parallel to said wall.

3. A balcony according to claim 1, in which the railing elements feature a telescopic structure, in such a way as to be extendable to a predetermined height when they are in the deployed position.

4. A balcony according to claim 1, in which said railing elements are respectively associated with sides of the edge of the balcony, and in which a tilt axis of each railing element is substantially parallel to the side of the balcony with which it is associated.

5. A balcony according to claim 4, in which each railing element is constituted by a frame of tubular elements, and comprises essentially at least two uprights or stanchions hinged to the edge of the support structure and a handrail extending between said uprights.

* * * * *